US006076698A

United States Patent [19]

Magidson

[11] Patent Number: 6,076,698

[45] Date of Patent: Jun. 20, 2000

[54] MOLDED STORAGE CONTAINER WITH DUAL COMPARTMENTS

[75] Inventor: Mark Magidson, Los Angeles, Calif.

[73] Assignee: Moldex-Metric, Inc., Culver City, Calif.

[21] Appl. No.: 09/177,198

[22] Filed: Oct. 22, 1998

[51] Int. Cl.[7] ..... B65D 1/24

[52] U.S. Cl. ..... 220/520; 220/4.03

[58] Field of Search ..... 220/520, 4.03, 220/23.86; 200/363

[56] References Cited

U.S. PATENT DOCUMENTS

| | | | |
|---|---|---|---|
| 300,441 | 6/1884 | Borst | 220/520 |
| 1,485,052 | 2/1924 | Reutter | 220/520 |
| 2,196,017 | 4/1940 | Kane . | |
| 2,221,191 | 11/1940 | James | 220/520 |
| 2,539,302 | 1/1951 | Fye | 220/520 |
| 3,310,905 | 3/1967 | Davis et al. | 220/520 |
| 3,899,072 | 8/1975 | Reinhart . | |
| 4,289,238 | 9/1981 | Warncke et al. . | |
| 4,550,856 | 11/1985 | Ballmann et al. . | |
| 4,561,543 | 12/1985 | Thompson . | |
| 4,702,378 | 10/1987 | Finkel et al. . | |
| 4,832,018 | 5/1989 | Pantaleon-Stemberg . | |
| 4,964,526 | 10/1990 | Stephens . | |
| 4,998,616 | 3/1991 | Hillinger | 220/520 |
| 5,063,940 | 11/1991 | Adell et al. . | |
| 5,370,255 | 12/1994 | Yang . | |
| 5,423,424 | 6/1995 | Young, III . | |
| 5,443,161 | 8/1995 | Jonese . | |
| 5,638,957 | 6/1997 | Brasier . | |
| 5,687,876 | 11/1997 | Lucas, Jr. . | |

*Primary Examiner*—Joseph M. Moy
*Attorney, Agent, or Firm*—Charles H Schwartz

[57] ABSTRACT

A molded storage container with dual compartments for storing a plurality of useful objects including a plurality of molded storage elements, each hinged to an adjacent storage element. A first storage elements forms a bottom wall of a first storage compartment and has a configuration approximating the configuration of the useful object. A second storage element folds about a first hinge and is spaced from the first storage element to form the top wall of the first compartment. The second storage element has a similar configuration to the first storage element and forms the bottom wall of a second storage compartment. A third storage element folds about a second hinge and is spaced from the second storage element to form the top wall of the second storage compartment smaller in size than the first storage compartment. The third storage element also has a similar configuration to the first and second storage elements. The molded storage container has dual compartments, one larger than the other and with the larger compartment for storing a plurality of useful objects and the smaller compartment for storing one of the useful objects.

5 Claims, 3 Drawing Sheets

FIG. 4
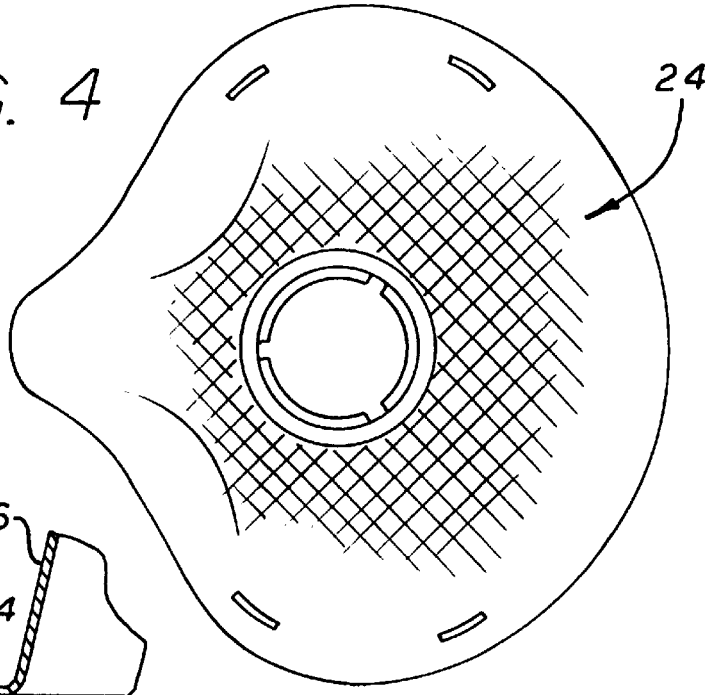
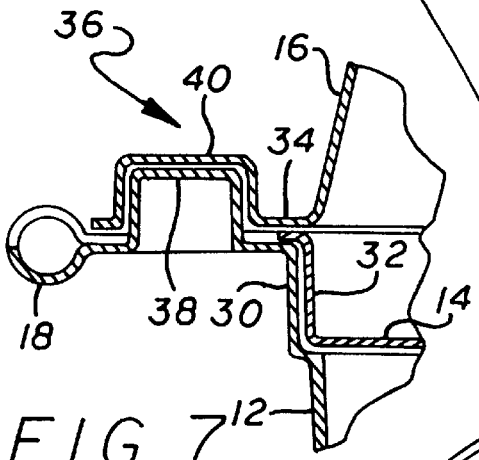
FIG. 7
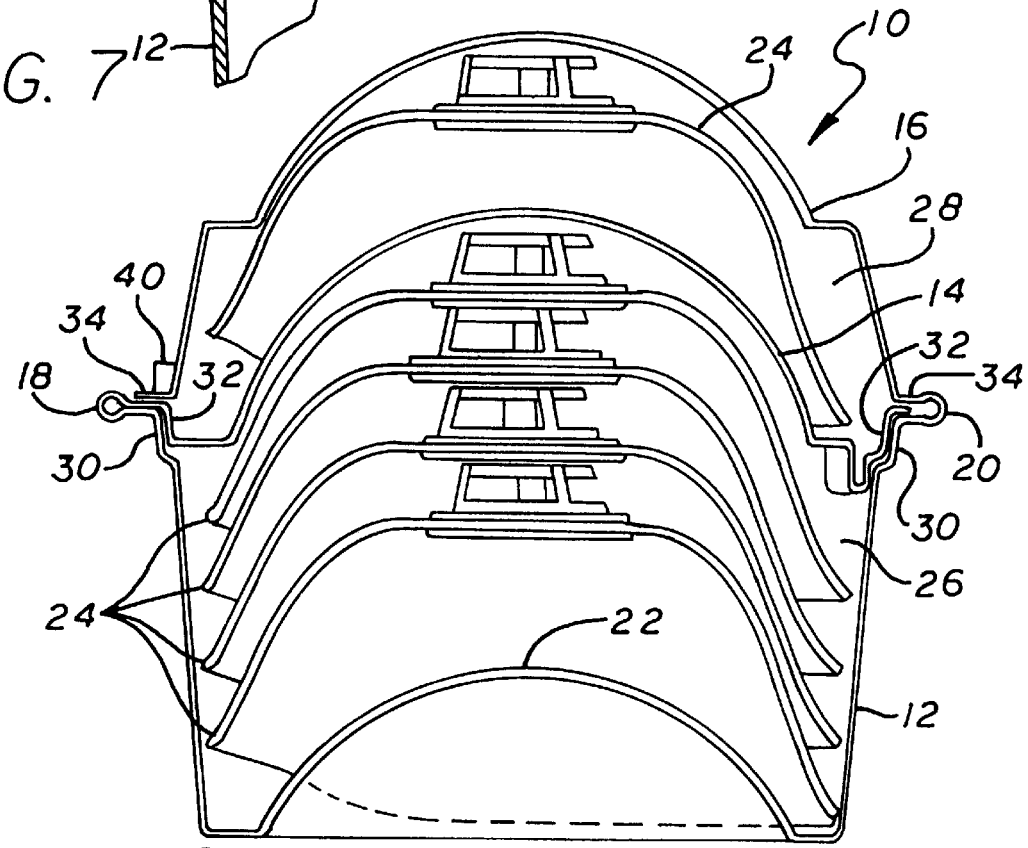
FIG. 6

MOLDED STORAGE CONTAINER WITH DUAL COMPARTMENTS

BACKGROUND OF THE INVENTION

1. Field of the Invention

The present invention relates to a storage container and specifically to a molded storage container with dual compartments for the storage of a plurality of substantially similar objects such as respirators in a first compartment and with the storage of a single object such as a respirator in a second compartment.

2. Background Information

It is often desirable to provide for a storage container for the storage of a plurality of useful objects, such as respirators in a convenient single package. Generally the user of the object would open the storage container and one of the useful objects, such as a respirator, would be removed from a storage compartment and used. Typically the useful object, such as the respirator, would be used for a period of time. If there is still useful life left for the useful object, it would be stored in some manner and then reused at a later time. If the useful object is to be reused, then it would be desirable to provide for a convenient place to store the useful object for it's eventual reuse. The most convenience place for storage would be the original storage container but the storage of the partially used object must not contaminate the storage of the multiple objects contained in the storage compartment.

Typically, in the prior art, the useful object such as the respirator, is removed and partially used and there is no convenient place to safely store the object for reuse at a later time. Therefore a need exists for an improved storage container for a useful object, such as a respirator, which will enable the storage container to store the multitude of useful objects in a first storage compartment and then provide for a second storage compartment to store a single one of the useful objects for reuse at a later time.

In the prior art there have been dual storage containers which provide for storage in two different compartments. In general such prior art dual storage containers are for storing two different types of objects in the dual compartments. The present invention provides for a storage container with dual compartments and with the various storage compartments designed to contain the same type of useful object such as a respirator.

SUMMARY OF THE INVENTION

As indicated above, the present invention provides for a storage container with dual compartments. Specifically the storage container is aunitary molded structure to provide for the dual compartments. One compartment is significantly larger than the other compartment but with both compartments generally having the same molded shape to conform to the useful object. One of the compartments has a greater depth to receive a multiple number of such useful objects usually in nested relationship and with the other compartment having a depth to receive only a single one of the useful objects. In this way a plurality of the useful objects, such as a respirator, may be initially stored in the larger compartment and with either a single one of the useful stored in the smaller compartment.

When the storage container is initially opened to gain access to the useful objects, such as a respirator, one of the useful objects may be removed and thereby used for its particular purpose. In the case of a respirator, the wearer would use the respirator to filter out contaminants in the air, typically in a workplace. Normally during use, the wearer of the respirator would remove the respirator at periodic times such as during breaks or during lunch. Therefore the respirator may be removed a number of times before the useful life of the respirator has expired.

During removal, the wearer of the respirator places the partially used respirator within the smaller of the two compartments. The compartments are separated from each other so that the partially used respirator will not contaminate the unused respirators. The wearer of the respirator, at a later time, removes the partially used respirator from the smaller compartment and uses the respirator for its intended purpose until the respirator is used up. At that time the respirator is discarded and a second one of the respirators contained in the larger compartment is then removed and used.

As can be seen, the smaller of the two compartments is used periodically to store partially used respirators until all of the respirators contained in the larger compartment are used in a normal fashion. The dual storage container therefore serves not only to provide for a supply of respirators, but also a convenient place to store individual partially used respirators without any contamination of the unused respirators and with the partially used respirator contained within a safe storage compartment.

The molded storage container with dual compartments of the present invention is molded as a unitary structure having integral hinge members. The unitary structure provides for three separate compartment elements with two hinges thereby forming the dual compartments. Generally a central compartment element together with a first hinged compartment element form a first compartment of a size for the storage of multiple useful objects such as respirators. The second hinged compartment element together with the first hinged compartment element form a second compartment of a size to store only a single useful object such as a respirator. The second compartment element together with the central compartment element also form a sealed structure for the two different compartments.

The present invention thereby provides for a dual storage container which is simple to mold, yet provides for a unique compartment structure for the desired storage of the same useful object in both of the compartments. Each compartment generally has a configuration to conform to the shape of the useful object and thereby minimize the outer size of the storage container.

BRIEF DESCRIPTION OF THE DRAWINGS

FIG. 4 is a top plan view of an individual useful object such as a respirator for placement within the molded storage container of the present invention;

FIG. 6 is a cross sectional view as taken along lines 6.6 of FIG. 3, but with a plurality of respirators, as shown in FIG. 4, located in the two storage compartments; and FIG. 7 is a detail of a locking structure taken along lines 7.7 of FIG. 3.

DESCRIPTION OF A PREFERRED EMBODIMENT

Figure 1:
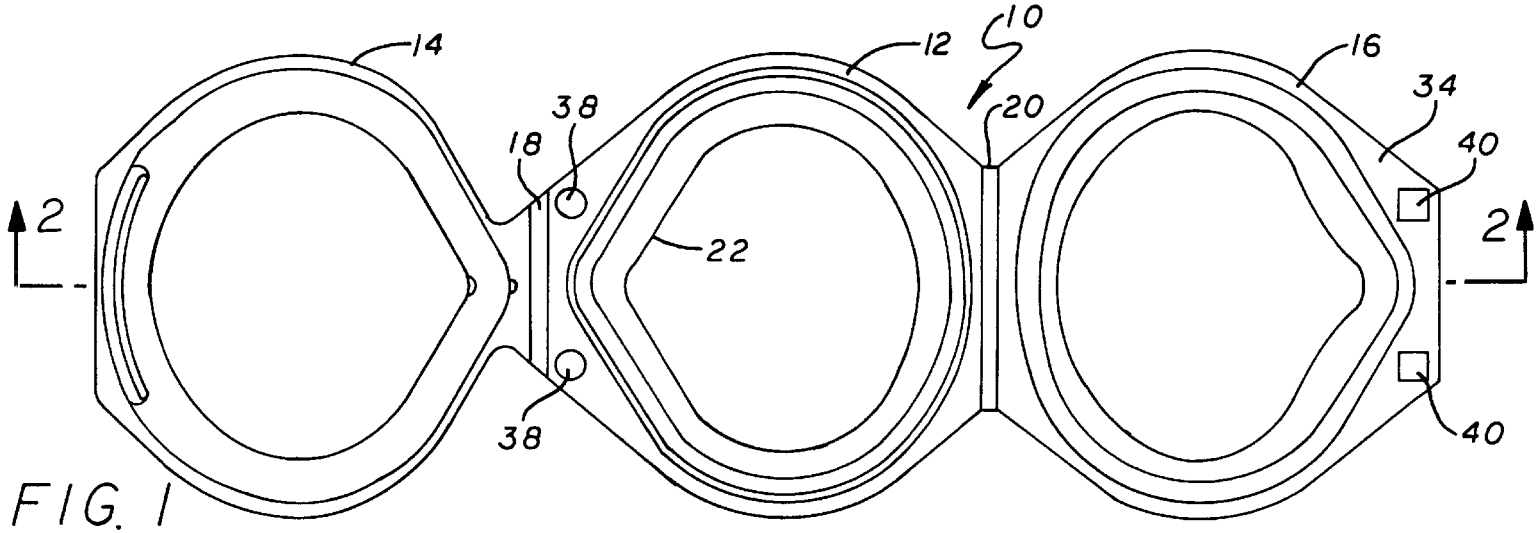
FIG. 1 is a top plan view of the molded storage container with dual compartments of the present invention in an open position.
Figure 2:
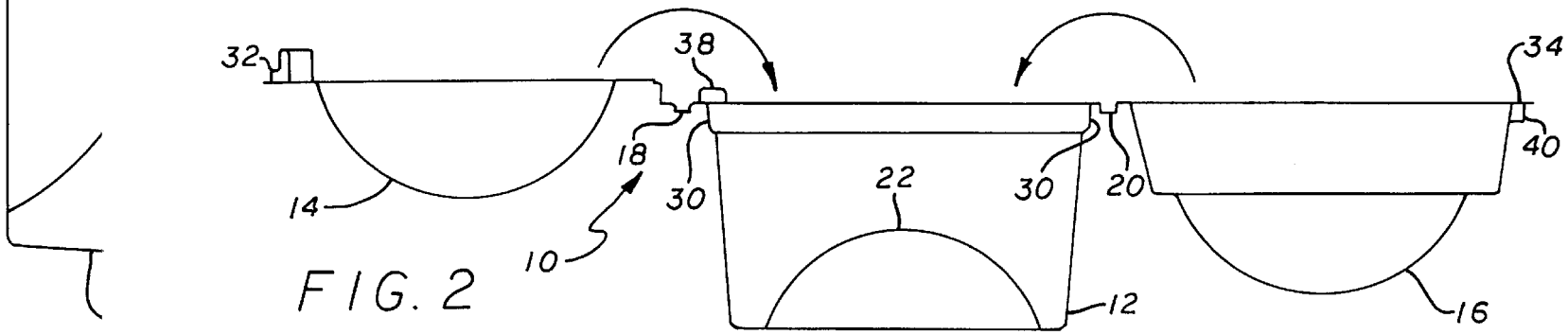
FIG. 2 is a cross sectional view of the molded storage container taken along lines 2—2 of FIG. 1.
Figure 3:
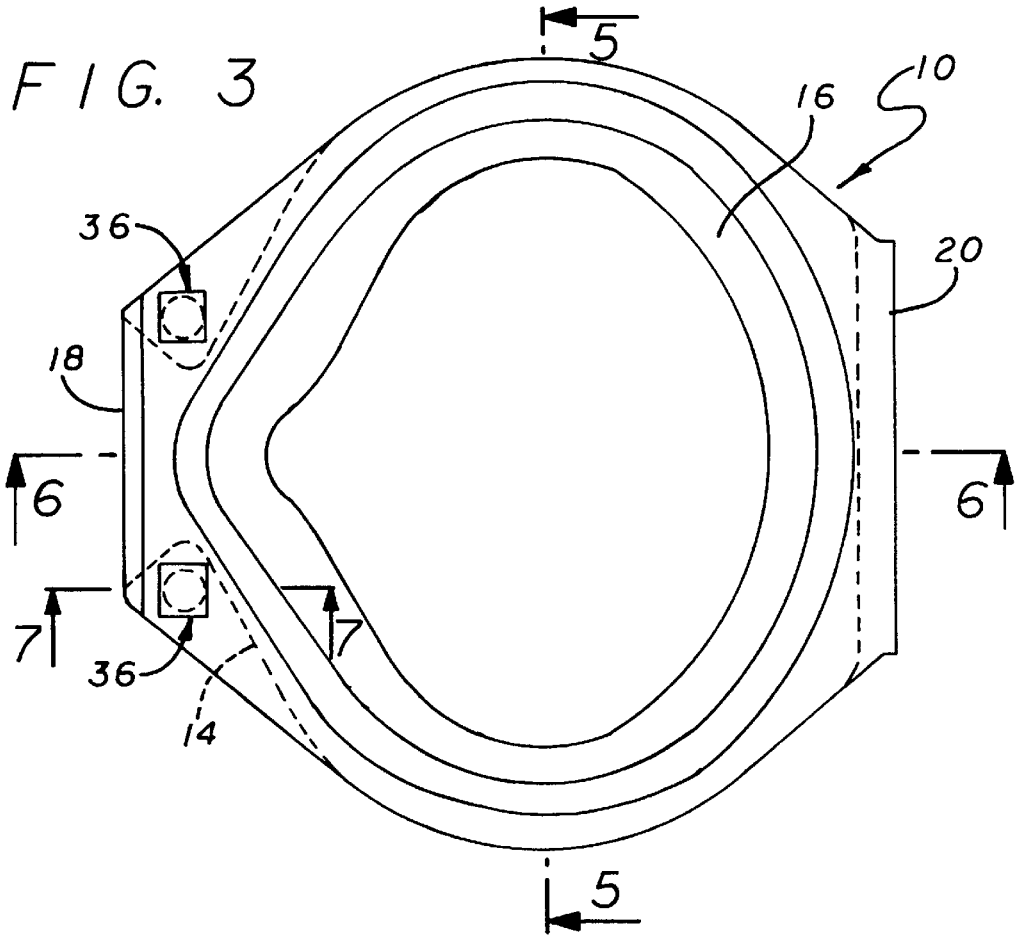
FIG. 3 is a top plan view of the molded storage container with the two outer storage elements folded into a closed position.

A molded storage container with dual compartments of the present invention is indicated generally by reference numeral 10 and preferably is formed of a molded unity plastic member. The container 10 has a central storage element 12 and two integrally molded side storage elements 14 and 16 and with all three elements interconnected by integral hinges 18 and 20. The central storage element 12, as seen in FIG. 2 has a dome-like portion 22, and as can be best seen in FIG. 1 the dome-like portion has a specific outer shape. The outer shape of the dome-like portion 22 conforms to the shape of the useful object to be contained within the container 10. Specifically, as seen in FIG. 4 and in cross section in FIG. 6, a respirator 24 has the same dome-like configuration and is thereby positioned over the similar dome-like portion 22

Figure 5:
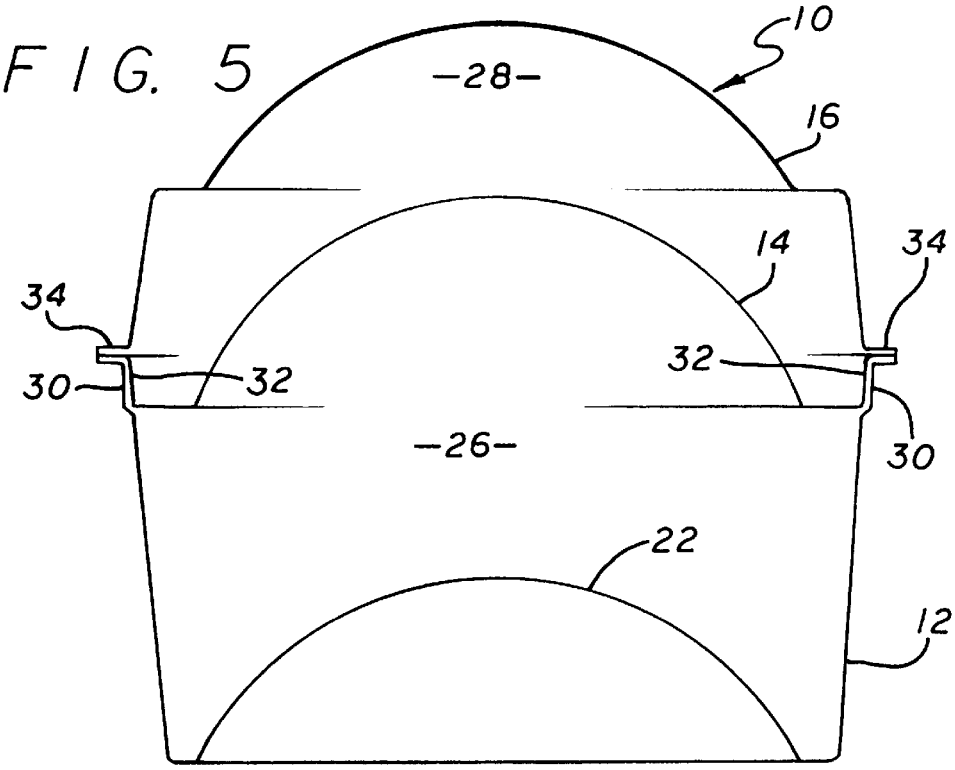
FIG. 5 is a cross sectional view of the molded storage container taken along lines 5—5 of FIG. 3; and with the storage container empty.

To form a first compartment, side storage element 14 is folded about the integral hinge 18 to be positioned over the central storage element 12. This forms a first large storage compartment 26 as shown in FIG. 5. This first storage compartment 26 may contain a plurality of respirators 24, such as four such respirators 24 shown in FIG. 6. It will be appreciated that more or less such respirators may be positioned within the larger storage compartment 26 depending upon the particular configuration or type of respirator to be stored. However the present invention contemplates at least two or more such useful objects such as respirators positioned in the larger of the two compartments of the molded storage container.

After the storage element 14 is folded over the storage element 12 along the integral hinge 18, a second similar compartment 28 is formed by folding over the storage element 16 about the integral hinge 20. The combination of the storage elements 14 and 16 form the second smaller compartment 28 as shown in FIG. 6. The smaller storage compartment 28 is designed to contain a single one of the useful objects such as the respirator 24 within such smaller storage compartment 28. Tie total container, shown in FIG. 6, provides for a, molded storage container with a multiple number of objects in the larger compartment 26 and a single object in the smaller compartment 28. As shown in FIG. 6 a particular container is supplied to a user of the respirators with a total of five such respirators, four packed in the larger compartment 26 and one in the smaller compartment 28.

In use, the user would typically snap open the top storage element 16 along the integral hinge 20 to provide access to the single respirator 24 in the smaller compartment 28. The user would then wear the respirator for some period of time and could periodically store the partially used respirator in the smaller upper storage compartment 28. When so stored, the partially used respirator cannot contaminate any of the unused respirators in the lower, larger storage compartment 26 because the individual storage compartments are separated one from the other.

After the first used respirator 24 has exhausted its useful filtering capability, the respirator is discarded and both storage elements 16 and 14 would then be opened to reveal the upper most of the nested respirators 24 located within the larger, lower compartment 26. This respirator would then be removed and the storage elements 14 and then 16 would be positioned as shown in FIGS. 5 and 6. Again, the user would wear the respirator 24 with periodic use of the upper, smaller storage compartment 28 for storage during the useful life of the respirator. When that respirator has served its useful life, it is discarded and the next nested respirator in the lower, storage compartment 26 is removed and worn and temporarily stored when necessary in the upper storage compartment. This continues until all of the respirators in the lower storage compartment 26 are used.

As can be seen from the FIGS. 1–3, 5 and 6, the individual storage compartments 26 and 28, although different in depth so as to accommodate multiple objects in the lower compartment are essentially similar in configuration so as to conform to the shape of the useful object. As shown, the conforming shape is that of a respirator, so as to properly store the respirators, and also minimize the outside size and dimensions of the storage container 10.

The storage container 10 of the present invention would typically be molded from a transparent plastic material so as to allow visibility to the interior of the storage compartments 26 and 28. In this way the user of the respirators 24 will know at all times if there is a respirator available in the upper storage compartment 28 that still has useful life and also will know the total number of fresh respirators that are available in the lower storage compartment 26.

It can be seen with reference specifically to FIGS. 2, 5 and 6 that the individual molded storage elements 12 and l4 include complementary circumferential surfaces designated with reference numerals 30 and 32 which complementary surfaces allow for the proper sealing relationship around the circumferential edges of the elements 12 and 14 by an interference fit. Also as shown in FIGS. 2, 5 and 6, storage element 16 includes a flange portion 34 which extends around the edge of the storage element 16 to seal container 10 from the environment. a pair of locking buttons 36 are formed by complementary protrutions 38 and 40 which provide locking, as shown in FIG. 7, of the storage element 16 to form the cover of the container 10.

It is to be appreciated that the present invention may be constructed in alternative ways. For example, the storage element forming the bottom wall of the lower storage compartment 26 may be located not in the center of the unitary structure but may be alternatively one of the side storage elements. The remaining two storage elements folding on top of the bottom storage element may be formed in a fan fold construction extending from one side of the bottom storage element rather than the particularly arrangement shown in the drawings.

Also it is to be appreciated that additional storage elements may be formed in a number greater than three so as to provide for more than two storage compartments and any number of storage compartments can be formed by such additional storage elements again arranged in a fan fold type of construction. The invention does however contemplate that at least one of the storage compartments be of a size to accommodate a single one of the useful objects such as a respirator. In this way, the useful object may be stored separately from the other useful objects and therefore allow for the separately stored useful object to be removed and returned to the smaller compartment without any contamination of the other useful objects in the at least one other larger storage compartment.

It should also be noted that, as shown in FIGS. 5 and 6, the top surface of the storage element 16 and the bottom surface of the storage element 12 are complementary in shape so that any number of storage containers 10 may be stacked, one upon the other, for easy storage of multiple containers 10.

Although the invention has been described with reference to a particular embodiment, it is to be appreciated that various adaptations and modifications may be made and the invention is only to be limited by the appended claims.

What is claimed is:

1. A storage container for respirators, including a three-piece plastic member formed of a central portion and two side portions each interconnected to the central portion by first and second hinges, the central portion having a central hump conforming in outer configuration and height to a respirator so that at least one respirator will lie over and be held in position by the central hump, one of the side portions foldable about the first hinge and having a hump substantially similar to the hump of the central portion and with the one side portion foldable about the first hinge to form a first compartment having a first depth defined by the distance between the hump of the central portion and the hump of the one side portion and with this first depth sufficient to receive a multiple number of respirators in nested configuration, and the other side portion formed with a hump conforming to the hump of both the central and one side portion and with the other side portion foldable about the second hinge to form a second compartment having a second depth defined by the distance between the hump of the one side portion and the hump of the other side portion and with this second depth sufficient to receive a single one of the respirators in the second compartment to provide for a storage container with dual compartments for receiving multiple respirators in the first compartment and for receiving a single respirator in the second compartment.

2. The storage container of claim 1 wherein the three-piece plastic member is formed of transparent plastic as that the interior of the storage compartments are visible.

3. The storage container of claim 1 wherein the central and side portions include complementary surfaces which provide for sealing around the periphery of the central and side portions so that the first and second compartments are sealed one from the other and to the outside environment.

4. The storage container of claim 1 wherein the hump of the central portion and the hump of the other side portion are complementary in shape so that a plurality of storage containers may be stacked one upon the other.

5. The storage container of claim 1 wherein the three-piece plastic member is a molded member and the hinges are integral.

* * * * *